US012650120B2

(12) United States Patent
Shi et al.

(10) Patent No.: US 12,650,120 B2
(45) Date of Patent: Jun. 9, 2026

(54) METHOD FOR OPERATING A PUMP SYSTEM

(71) Applicant: Leybold GmbH, Cologne (DE)

(72) Inventors: Yun Shi, Cologne (DE); Joeri Coeckelbergs, Cologne (DE)

(73) Assignee: Leybold GmbH, Cologne (DE)

( * ) Notice: Subject to any disclaimer, the term of this patent is extended or adjusted under 35 U.S.C. 154(b) by 247 days.

(21) Appl. No.: 18/246,970

(22) PCT Filed: Sep. 15, 2021

(86) PCT No.: PCT/EP2021/075334
§ 371 (c)(1),
(2) Date: Mar. 28, 2023

(87) PCT Pub. No.: WO2022/069229
PCT Pub. Date: Apr. 7, 2022

(65) Prior Publication Data

US 2023/0366392 A1 Nov. 16, 2023

(30) Foreign Application Priority Data

Sep. 29, 2020 (GB) ..... 2015357

(51) Int. Cl.
*F04B 37/14* (2006.01)
*F04B 41/06* (2006.01)
(Continued)

(52) U.S. Cl.
CPC ..... *F04B 37/14* (2013.01); *F04B 41/06* (2013.01); *F04B 49/08* (2013.01); *F04B 49/20* (2013.01); *F04B 2203/0208* (2013.01)

(58) Field of Classification Search
CPC ..... F04B 37/14; F04B 41/06; F04B 49/08; F04B 49/20; F04B 2203/0208; F04C 23/001–003; F04C 25/02; F04C 2220/10
See application file for complete search history.

(56) References Cited

U.S. PATENT DOCUMENTS 3,744,932 A * 7/1973 Prevett ..... G05D 9/12 417/7
4,655,688 A * 4/1987 Bohn ..... F04C 19/001 417/18

(Continued)

FOREIGN PATENT DOCUMENTS

CN 1993040 A * 7/2007 ..... A01J 5/007
CN 100468629 C 3/2009

(Continued)

OTHER PUBLICATIONS

PCT International Search Report dated Nov. 26, 2021 for corresponding PCT application Serial No. PCT/EP2021/075334, 6 pages.

(Continued)

*Primary Examiner* — Alexander B Comley
(74) *Attorney, Agent, or Firm* — Theodore M. Magee; Westman, Champlin & Koehler, P.A.

(57) ABSTRACT

Method for operating a pump system having more than one pump, including the steps of: Obtaining at least one target parameter to be optimized based on target values of each pump; Obtaining an operation target, wherein the operation target is provided by one or more of the pumps operating each with an individual operation parameter; Acquiring a relationship for more than one and preferably all of the pumps between the operation parameter and the target value and determine a target function; Determining a maximum/minimum of the target function and obtaining operation parameter of at least one pump; and Controlling of at least one pump to operate with the obtained operation parameter to optimize the target parameter.

8 Claims, 4 Drawing Sheets

(51) Int. Cl.
*F04B 49/08* (2006.01)
*F04B 49/20* (2006.01)

(56) References Cited

U.S. PATENT DOCUMENTS

| | | | | | |
|---|---|---|---|---|---|
| 6,659,726 | B2 * | 12/2003 | Holden | F04C 28/08 | 417/2 |
| 7,278,831 | B2 * | 10/2007 | Bailey | H01L 21/67155 | 417/313 |
| 2003/0068233 | A1 * | 4/2003 | Royce | F04C 25/02 | 417/251 |
| 2008/0041315 | A1 * | 2/2008 | Stellnert | F04B 41/06 | 119/14.08 |
| 2008/0145238 | A1 * | 6/2008 | Shibayama | F16K 15/042 | 418/206.1 |
| 2012/0204965 | A1 * | 8/2012 | Loldj | F04D 19/04 | 137/14 |
| 2015/0377226 | A1 * | 12/2015 | Stones | F04B 41/06 | 454/341 |
| 2018/0112666 | A1 * | 4/2018 | Dreifert | F04C 28/06 | |
| 2019/0055945 | A1 * | 2/2019 | Coeckelbergs | F04C 25/02 | |

FOREIGN PATENT DOCUMENTS

| | | | | | |
|---|---|---|---|---|---|
| CN | 108331735 | A * | 7/2018 | B23Q 3/088 | |
| CN | 109556236 | A | 4/2019 | | |
| CN | 110654360 | A * | 1/2020 | B60T 13/46 | |
| DE | 2756916 | C2 * | 9/1985 | | |
| EP | 3597916 | A1 | 1/2020 | | |
| FR | 2792083 | A1 * | 10/2000 | F04B 49/065 | |
| GB | 2502134 | A * | 11/2013 | F04C 23/005 | |
| JP | S54157361 | A | 12/1979 | | |
| JP | S57202102 | A | 11/1983 | | |
| JP | S58202102 | A | 11/1983 | | |
| JP | 2016160917 | A | 9/2016 | | |
| JP | 2017174399 | A | 9/2017 | | |
| KR | 20200099266 | A | 8/2020 | | |
| WO | 2011117489 | A | 9/2011 | | |
| WO | WO-2014040627 | A1 * | 3/2014 | F04D 1/04 | |
| WO | WO-2018100342 | A1 * | 6/2018 | F04B 37/14 | |

OTHER PUBLICATIONS

PCT Written Opinion dated Nov. 26, 2021 for corresponding PCT application Serial No. PCT/EP2021/075334, 8 pages.
British Search Report dated Feb. 24, 2021 for corresponding British application Serial No. GB2015357.3, 2 pages.
Taiwanese Search Report dated Feb. 13, 2025 and Office Action dated Jan. 24, 2025 for corresponding Taiwanese application Serial No. 110136139, 34 pages.
Japanese Notification of Reasons for Rejection dated Jul. 14, 2025 for corresponding Japanese application Serial No. 2023-519623, 5 pages.
Chinese Search Report dated Sep. 11, 2025 for corresponding Chinese application Serial No. 202180066860.3, 2 pages.
Korean Office Action dated Dec. 19, 2025 for corresponding Korean application Serial No. 2023-7010226, 17 1 pages.

* cited by examiner

METHOD FOR OPERATING A PUMP SYSTEM

CROSS-REFERENCE OF RELATED APPLICATION

This application is a Section 371 National Stage Application of International Application No. PCT/EP2021/075334, filed Sep. 15, 2021, which is incorporated by reference in its entirety and published as WO 2022/069229 A1 on Apr. 7, 2022, the content of which is hereby incorporated by reference in its entirety and which claims priority of British Application No. 2015357.3, filed Sep. 29, 2020.

BACKGROUND

The present invention relates to a method for operating a pump system preferably comprising more than one pump, i.e. vacuum pump or compressor, built as Variable-Speed pump (VSD) or Fixed-Speed pump (FS). Further, the present invention relates to a pump system.

A pump system may comprise different types of pumps and/or different pumps in order to provide an operation target to the customer such as a certain flow or certain pressure, i.e. a vacuum or a pressurized fluid. Therein, the individual pumps of the pump system can be controlled in various ways in order to provide the operation target.

Therein, it is in the intention of a customer to run the pump system in an optimal state, i.e. to minimize the energy consumption. However, in particular for the energy consumption, there is a complex dependency individual for each pump type (scroll-pump, screw-pump, or the like) and each pump (e.g. two screw-pumps with different size or capacity) between the operation value (such as running speed or the like) of each pump contributing to the operation target and the respective target parameter. For example, FIG. 1 shows a non-linear relationship between the flow and the power consumption, i.e. the power consumption per unit flow or power consumption efficiency, for an exemplified vacuum pump. A different vacuum pump will have another relationship. Further, constraints must be considered for each pump: each VSD pump can provide a continuous flow between its minimum and maximum flow. However, VSD pump cannot deliver a flow between 0 and its minimum, neither can it deliver a flow above its maximum. Each FS can only deliver two values of the flow: 0 or its maximum. The total flow needs to be within a certain range around the operation target provided to the customer. In light of the complex dependencies between the operation value of each pump and the given constrains, it is a non-obvious task to operate a pump system at its optimum.

Thus, it is an object of the present invention to provide a method for operating a pump system in an optimized state.

The problem is solved by the method.

The discussion above is merely provided for general background information and is not intended to be used as an aid in determining the scope of the claimed subject matter. The claimed subject matter is not limited to implementations that solve any or all disadvantages noted in the background.

SUMMARY

The method according to the present invention for operating a pump system preferably comprising more than one pump, i.e. vacuum pumps and/or compressors, wherein each of the pumps might be built as Variable-Speed pump (VSD) or Fixed-Speed pump (FS) comprises the steps of:

Obtaining at least one target parameter to be optimized based on target values of each pump;

Obtaining an operation target, wherein the operation target is provided by one or more of the pumps operating each with an individual operation parameter;

Acquiring a relationship for more than one and preferably all pumps of the pump system between the operation parameter and the target value, and determine a target function;

Determining a maximum/minimum of the target function and obtaining operation parameter of at least on pump; and Controlling of at least one pump to operate with the obtained operation parameter to optimize the target parameter.

Therein, the target parameter to be optimized is the target parameter for the complete pump system wherein each individual pump contributes to the target parameter by the target value of each pump.

Therein, the operation target is given by the task of the pump system, i.e. the customer, wherein the operation target is provided by one or more of the pumps of the pump system combinedly wherein each of the pumps is operating with an individual operation parameter contributing to the operation target.

The relationship for the considered pumps between the operation parameter of the specific pump and the target value can be determined as a functional relationship or by a look-up table. This relationship is known for the pump by the manufacturer of the pump and can be easily implemented. Further, the target function provides a functional relationship between the operation target and the target parameter for the considered pump based on the individual relationship of each considered pump between the operation parameter and the target value.

From the target function a maximum or minimum is determined as optimization point and thereby obtaining operation parameter of at least one or more pumps. In particular, operation parameters for the optimum state are determined for each of the considered pumps.

With the obtained operation parameter for each pump at least one pump is operated in order to optimize the target parameter.

Hence, first an operation target is defined together with a target parameter, wherein the target parameter shall be optimized. Then for each pump a relationship between the target values and the operation parameter are established and a target function is determined. By the target function optimized operation parameter for at least one pump is obtained and then the pump system is controlled by this at least one optimized obtained version parameter in order to optimize the target parameter. Preferably, an optimized operation parameter is determined from the target function for each of the pumps and even more preferably for each pump of the pump system.

Preferably, the operation target is flow or pressure provided by the pump system. Thus, the pump system must provide a certain flow or pressure in accordance with the task delivered by the pump system. Therein, the pumps in the pump system need to be controlled to provide the operation target, i.e. the flow or pressure, while optimizing the target parameter of the pump system. Therein, preferably, the operation target needs to be within margin-offsets defined by the task and to be delivered by the pump system. Therein, the operation target must be within these margins to ensure quality of service of the pump system. If the operation target is the flow for example, then the operation parameter of an individual pump might be running speed in order to provide a certain flow such that the sum over all pumps results in the operation target. The same applies if the operation target is the pressure or any other operation target defined.

Preferably, the target parameter is one or more of energy consumption, water/oil consumption, maintenance reduction of the pump system. Thus, by the present invention it is intended to reduce the energy consumption and/or water/oil consumption and/or increase the maintenance intervals of the pump system. Preferably, one or more of the target parameters can be combined wherein preferably a prioritization of the target parameters is possible. If the target parameter is energy consumption, then the target value of an individual pump is the energy consumption of the individual pump.

Preferably, determining a maximum/minimum of the target function is performed in a first run with the FS considered as a VSD providing continuous operation parameter. In the real world, as mentioned above, FS can only provide 0 or maximum speed or flow. However, in order to find reliably a maximum/minimum of the target function, the FS are considered as VSD providing continuous operation parameters. Thus, it is ensured that a maximum/minimum of the target function can be found or at least operation parameters of at least one pump is found close to this optimum.

Preferably, if in the first run not all FS having an operation parameter being 0 or full speed, i.e. the operation parameter can be matched to the real operation states of the FS and the FS can be controlled accordingly, using the determined operation parameters of the first run as starting point for a second run for determining a maximum/minimum of the target function wherein a step size for determining the maximum/minimum of the target function is increased. In particular, the step size is increased for the FS only. Therein, by increasing the step size close to the complete operation range of the FS, being 0 and maximum speed, at the end of the second run it is ensured that for the FS operation parameters of either 0 or full speed for each FS is determined. Thus, at least by the second run operation parameter for the considered pumps can be determined close to the optimum with which the individual pumps can be controlled to be operated in order to optimize the target parameter.

Preferably, if the operation target is the flow provided by the pump system and the optimization parameter is the energy consumption or water/oil consumption then the target function is given by $$f(x) = \sum_{i=1}^{n} g_i(x_i * Q_{imax}) + \sum_{j=1}^{m} x_j * \text{Power}_j.$$

Therein, Q denotes the flow distributed among all the available pumps. $Q_i$ denotes the flow of the $\text{pump}_i$ being either VSD or FS and $x_i$ denotes the flow ratio that is compared to the maximum flow of the pump i at the setpoint pressure by $$x_i = \frac{Q_i}{Q_{imax}}.$$

Further, $g_i$ denotes the look-up table for the power consumption of pump i at the setpoint pressure for a VSD. $\text{Power}_j$ denotes the fixed power of pump j at the setpoint pressure for a FS. n denotes the number of all available VSD while m denotes the number of all available FS. Then the target parameter is given by the target vector $X=\{x_1,x_2, \ldots x_n, \ldots x_{n+m}\}$ to be optimized.

Preferably, constrains are considered. For the VSD the flow of the vacuum pump is given by $$x_i \in \{0\} \& \left[\frac{Q_{imin}}{Q_{imax}}, 1\right],$$

meaning that the VSD can either provide zero flow or a flow between its minimum and its maximum flow. The constrains for the FS are with respect to the flow given by $x_j \in \{0,1\}$, meaning that the FS can provide either zero or maximum flow. Further, the provided flow must be within margins of the required flow in order to perform the task of the connected pressurized system.

Preferably, the minimum/maximum of the target function is determined by the numerical gradient given by $x'_i = x_i - lr * \text{grad}_{xj}$ for each of the pumps with lr as the step size, providing the operation parameter $x'_i$.

Preferably, the step size for the first run is below 0.2 and preferably below 0.1 in order to ensure reliably finding the maximum/minimum of the target function. However, this will result in unrealistic values for the FS having operation parameters between 0 and 1.

Preferably, the step size for the second run is above 0.5 and preferably 1 in order to ensure that the operation parameter of the FS is either 0 or 1 which is possible to run the FS with. Thus, if the first run of the determination of the maximum/minimum of the target function provide for the FS operation parameters between 0 and 1 which can not be implemented by the FS, the second run is necessary, wherein due to the increased step size, the operation parameter of the FS are forced to be either 0 or 1.

Preferably, if the target parameter includes maintenance reduction then the method further includes the steps of sorting the pumps by the running hours selecting those pumps with minimum running hours which together can provide the operation target. If the target parameter is maintenance reduction alone than the selected pumps are controlled to provide the operation target. Thereby, it is ensured that none of the pumps in the pump system exceed the running hours for the next maintenance, thereby increasing the maintenance interval.

If the target parameter includes energy consumption or water/oil consumption together with the maintenance reduction, the selected pumps are included into the target function in order to find the operation parameters for the selected pumps in order to optimize the target parameter of energy consumption as well. In particular, more pumps can be included into the target function in the order of the running hours in order to be able to provide more degrees of freedom to optimize the target parameter. If two pumps are sufficient in order to provide the operation target but five pumps in the pump system are below a given threshold for the running hours, all five pumps are included into the target function in order to determine the optimized target parameter.

Preferably, the threshold of the number of considered pumps or the threshold for the maximum running hours for considering the pump in the target function is determined according to a priority value in particular set by the costumer or predetermined, providing a priority of the target parameter. Therein, if the priority is the maintenance reduction only those pumps are selected which are necessary in order to provide the operation target. If the priority is the energy consumption or water/oil consumption, then more pumps and preferably all pumps of the pump system are considered regardless of their running hours. For a shifting priority from the maintenance reduction towards the energy consumption or water/oil consumption, more and more pumps will be considered by the target function having running hours closer to the next maintenance interval. Thereby, increasing the degrees of freedom of the target function in order to provide an optimum of the target parameter.

In another aspect of the present invention a pump system is provided comprising more than one pump. Therein, the pumps can be vacuum pumps and/or compressors. Further, each of the pumps is preferably built as Variable Speed pump (VSD) or Fixed-Speed vpump (FS). Further, the pump system comprises a controller connected to each pump in order to control operation of the pumps. Therein, the controller is configured to perform the method according to the above description.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

In the following the present invention is described in more detail with reference to the accompanied drawings.

The figures show.

DETAILED DESCRIPTION

The method according to the present invention relates to operating a pump system. Therein, preferably the pump system comprises more than one pump, wherein each pump might be built as Variable Speed pump (VSD) or Fixed-Speed pump (FS). Each of the pumps might be a compressor or a vacuum pump. Preferably, more than one VSD and/or more than one FS are employed. Therein, the pumps in the pump system work together in order to provide a flow or pressure to the pressurized system connected to the pump system in order to perform a certain task.

Figure 2:
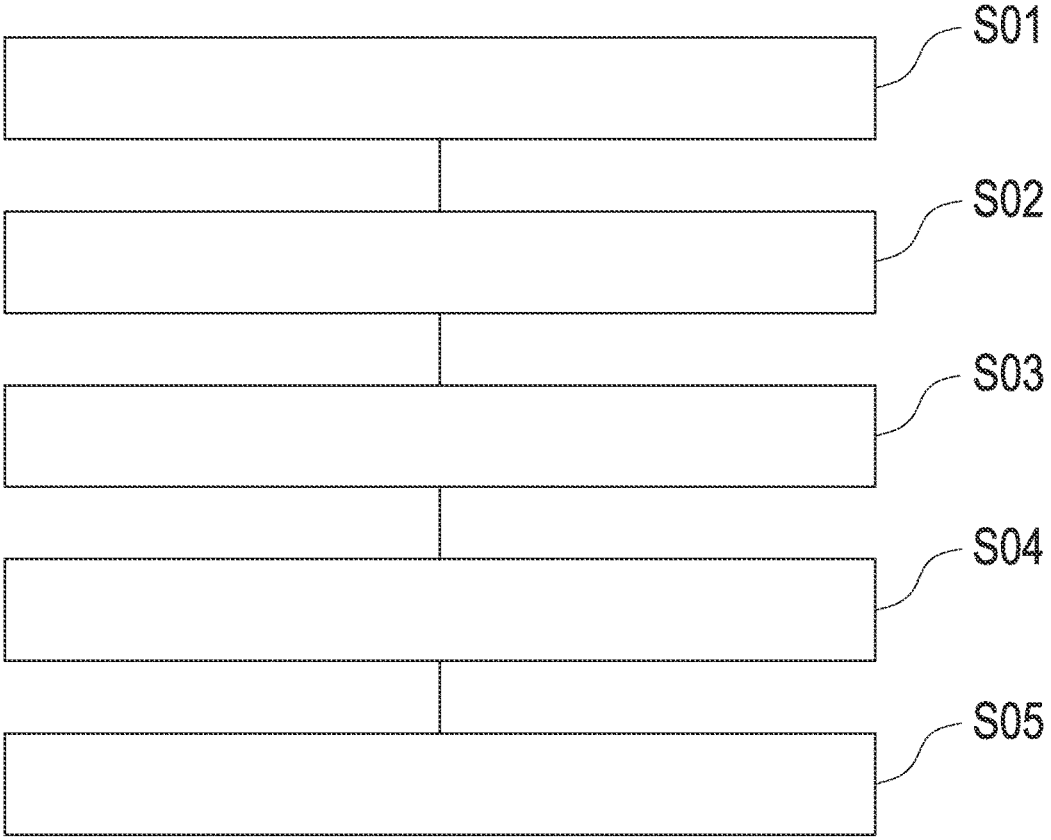

The steps of the method according to the present invention are depicted in FIG. 2:

In step S01, at least one target parameter to be optimized is obtained either by presetting the target parameter by the manufacturer or by an input operation of the customer. Therein, the target parameter is based on the target value of at least one and preferably the target value of each pump in the pump system. Thus, the target parameter in fact represents the parameter which shall be optimized by the present operating method. Preferably, the target parameter might be the energy consumption of the pump system or the water/oil consumption of the pump system (in particular if a waterring pump is employed) or the maintenance reduction of the pump system, i.e. increase of the maintenance intervals for the pump system. Therein, each of the pumps within the pump system contributes to the target parameter by its individual target value, for example each pump has a certain energy consumption combining with the energy consumption of the other pumps in the pump system resulting in the complete energy consumption of the complete pump system to be optimized as target parameter.

In step S02, at least an operation target is obtained either by presetting the operation target by the manufacturer or by an input operation of the customer. Therein, the operation target might be a flow or a pressure delivered by the pump system. Therein, the operation target is provided by one or more of the pumps of the pump system operating each with an individual operation parameter. Therein, the operation parameter denotes the contribution of the respective pump to the combined operation target of all pumps in the pump system or at least of the considered pumps in the pumps system. Therein, the operation parameter might be related to the running speed of the pump.

Figure 1:
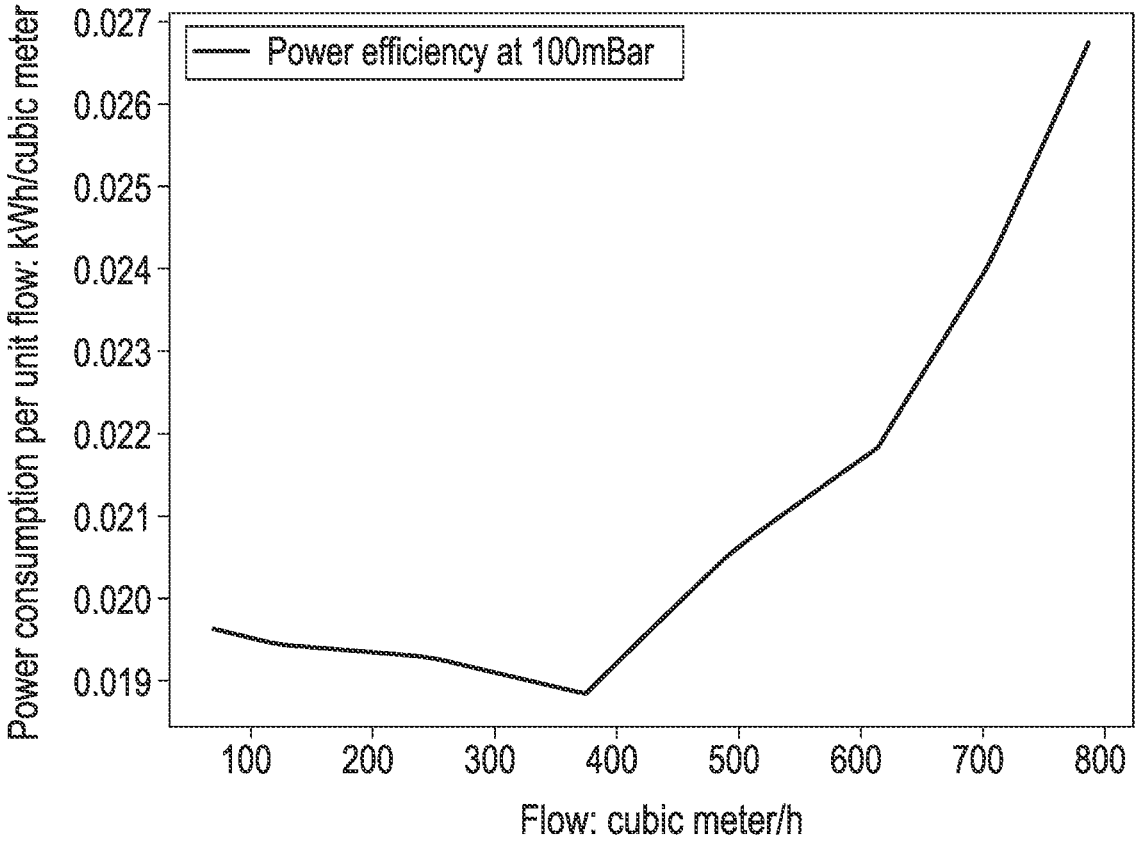
FIG. 1 an exemplified relationship of a certain pump between the flow and power consumption per unit flow, FIG. 2 an embodiment of the method according to the present invention, FIG. 3*a* detailed embodiment of the method according to the present invention, FIG. 4A a detailed embodiment of the method according to the present invention, FIG. 4B an example of the embodiment given in FIG. 4*a* and FIG. 5 an embodiment of the pump system according to the present invention.

In step S03, a relationship is acquired for each pump between the operation parameter and the target value. In particular, if in the pump system different types of pumps and/or different pumps, such as different sizes, ages or pumps of different manufacturers are applied, there is a specific relationship for each individual pump between the operation parameter, such as the running speed of the pump or the provided flow at a certain pressure and the specific target value, e.g. the energy consumption. Therein, the relationship is usually non-linear. An example for of such a relationship between the flow and the energy consumption for a certain vacuum pump is depicted exemplarily in FIG. 1 showing the non-linear behavior. Therein, the relationship between the operation parameter and the target value for each pump might be provided by a look-up table. From the acquired relationship for each pump a combined target function for each of the considered pumps in the pump system and preferably for all pumps in the pump system is determined. Therein, the target function provides a relationship between the operation parameters of each of the considered pumps and the target parameter.

In step S04, a maximum or minimum of the target function is determined. Therein, the maximum or minimum is selected depending on the target parameter to be optimized, whether this target parameter need to be maximized or minimized. For example, energy consumption is of course to be minimized, resulting in determining a minimum of the target function. Therein, from the maximum/minimum of the target function an operation parameter of at least one pump and preferably operation parameters for each of the pumps in the pump system are obtained.

In step S05, the at least one pump and preferably all pumps in the pump system are controlled to operate with the obtained operation parameter to optimize the target parameter. Thus, by determining the maximum/minimum of the target function, the target parameter can be optimized and respective operation parameters for the considered pumps can be obtained. Therein, the operation parameter is selected such that the operation target is still met, i.e. the pump system provides a required flow or pressure in order to perform a certain task by the pump system.

In a specific example Q denotes a flow that to be distributed among all available pumps as operation target. Further, $Q_i$ denotes a flow that the pump i delivers and $x_i$ denote the flow ratio that is compared to the maximum flow of the pump i at the setpoint pressure according to $$x_i = \frac{Q_i}{Q_{imax}}.$$

Further, $g_i$ denotes a look-up table for the power of pump i at a setpoint pressure being a VSD. Similarly, let $\text{Power}_j$ denote the fixed power that pump j consumes at the setpoint pressure being a FS. Further, let n denotes the number of all available VSDs and let m denote the number of all available FS. Then the target parameter is a vector $X=\{x_1,x_2, \ldots x_n, \ldots x_{n+m}\}$ to be optimized and the target function can be provided by $$f(x) = \sum_{i=1}^{n} g_i(x_i * Q_{imax}) + \sum_{j=1}^{m} x_j * \text{Power}_j.$$

The target function underlays some constrains since the VSD can either deliver no flow or a flow between the VSDs minimum flow and its maximum flow, i.e.

$$x_i \in \{0\} \& \left[\frac{Q_{imin}}{Q_{imax}}, 1\right].$$

The FS pumps can provide only 0 flow or its maximum flow, i.e. $x_j \in \{0,1\}$.

Further, the operation target must be within certain margins delimited by $\text{offset}_{low}$ and $\text{offset}_{high}$ which can be written as $$Q - \text{offset}_{low} \leq \sum_{i=1}^{n} Q_i + \sum_{j=1}^{m} Q_j \leq Q + \text{offset}_{high}.$$

Due to the numerous pumps and their individual dependencies it is not possible to directly determine the gradient for each of the pumps individually. Further, numeric gradients cannot be determined for step functions. Instead each descent step is split into n sub steps, wherein N=n+m refers to the total number of pumps. In each sub step i it is calculated $$x_1' = x_1 - lr * \text{grad}_{x_1}$$

$$x_2' = x_2 - lr * \text{grad}_{x_2}$$

$$x_n' = x_n - lr * \text{grad}_{x_n}$$

$$x_i' = g^{-1}(\text{flow}_{demand} - g(x_1', x_2', \ldots, x_N'))$$

with $g^{-1}$ being the function which converts the flow $Q_i$ into the ratio $x_i$. Therein, the step size lr is not always fixed. Instead the step size lr might be adapted in each sub step. The result of the sub step whose total power consumption is minimum is received as the output of the step. Thus, by the above calculation the target parameter approaches its optimum in small steps lr considering continuous flow that can be provided by the VSD.

However, if the same approach is adapted to the FS having only the flow corresponding to 0 or the maximum flow of the FS, resulting in undesired and unrealistic results which cannot be realized by the FS.

Figure 3:
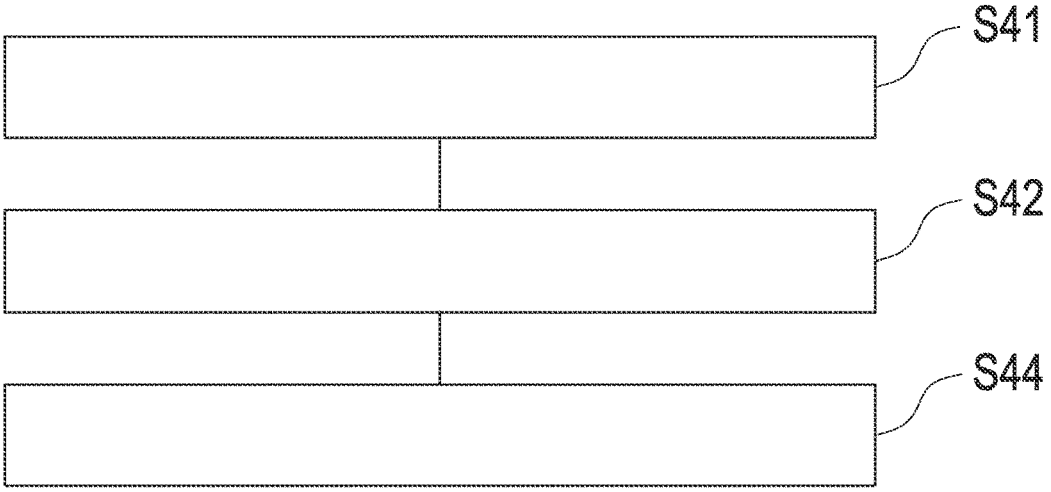

A solution is provided and depicted in FIG. 3. In step S41, determining of a maximum/minimum of the target function is performed in a first run with the FS considered as VSD, i.e using small steps towards the optimum of the target parameter. Therein, the step size lr is preferably below 0.2 and even more preferably below 0.1.

In step S42, it is checked whether in the first run all FS have an operation parameter equal to 0 or full speed which can be delivered by the FS.

In step S43, if not all FS have an operation parameter equal to 0 or full speed, the operation parameters determined in step S41 are used as starting points for a second run for determining the maximum/minimum of the target function, wherein the step size lr for determining the maximum/minimum of the target function is increased for the FS. Preferably, the step size lr is selected to be above 0.5 and preferably 1. Thus, due to the first run the operation parameters are already close to the optimum with respect to the target parameter. In the second run due to the increased step size of lr it is ensured that for each of the FS an operation parameter equal to 0 or 1 is obtained.

Thus, by the two runs of the determination of the maximum/minimum of the target function on the one hand, the operation parameters for an optimized target parameter can be found, wherein for the FS the constrains are considered providing either 0 flow or its maximum flow. As a consequence, a pump system with a plurality of different pumps including VSD and FS pumps can be reliably operated in an optimized state.

Figure 4A:
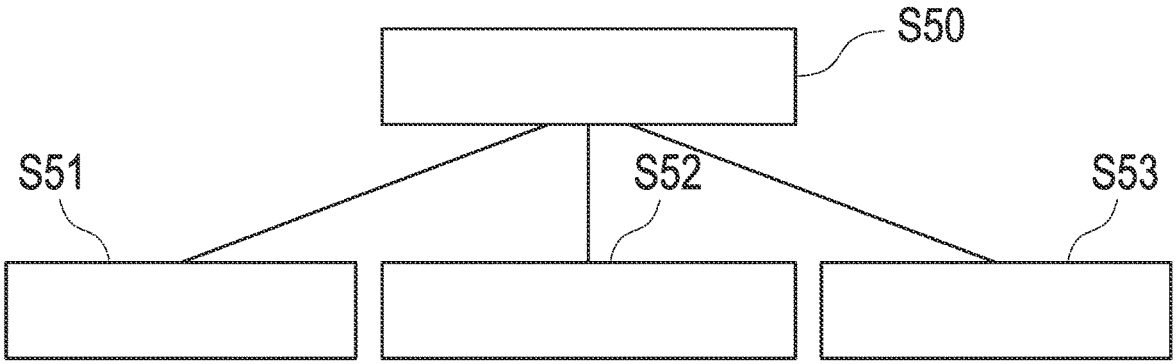
Figure 4B:
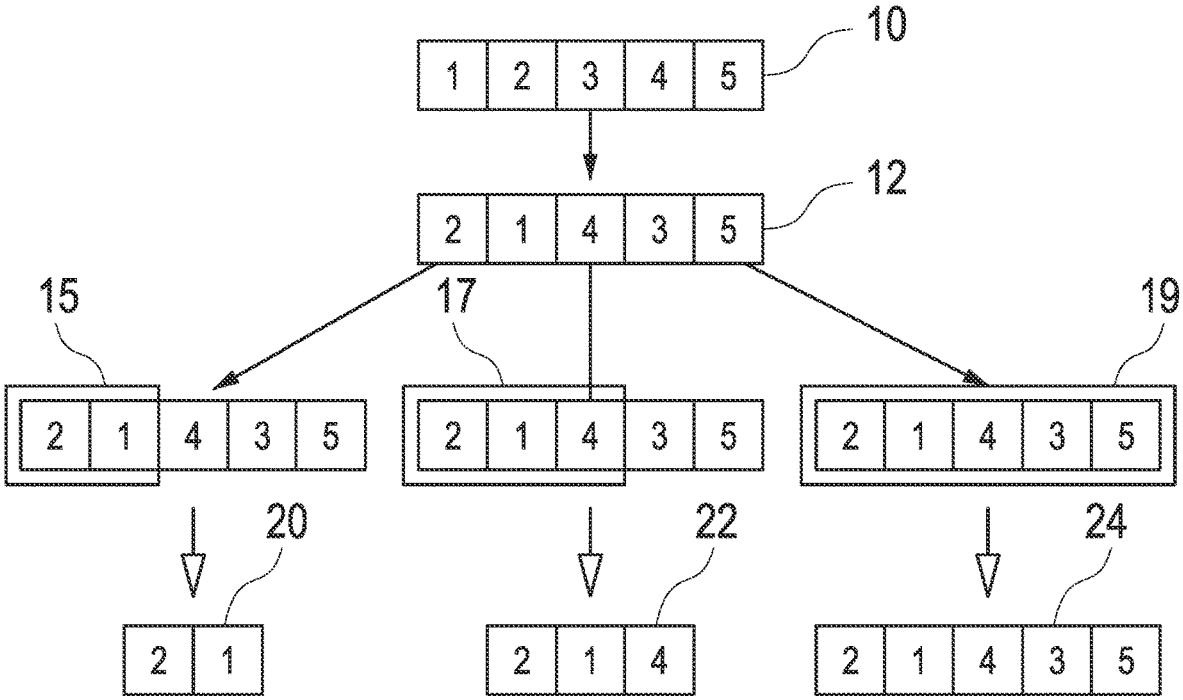

Alternatively, the target parameter can also be reduction of the maintenance or increase of maintenance intervals as depicted in FIGS. 4A and 4B. In step S50 the considered pumps and preferably all pumps of the pump system are sorted by the running hours. In step S51 those pumps with minimum running hours are selected which together can provide the operation target. The situation is also exemplarily depicted in FIG. 4B for a vacuum pump system having five vacuum pumps 10. These vacuum pumps are in accordance to step S50 sorted by the running hours to form the sorted vacuum pumps 12. Those vacuum pumps 15 are selected which are able to provide the operation target. In the example of FIG. 4B the selected vacuum pumps 15 being vacuum pumps 2 and 1 which are sufficient in order to provide the operation target. Thus, only vacuum pumps 2 and 1 are controlled to be operated as operating vacuum pumps 20 in order to provide the operation target, thereby reducing the maintenance requirements, i.e. increasing the maintenance intervals.

Further, it is possible to prioritize either the reduction of energy consumption or the increase of maintenance intervals. If the reduction of the energy consumption has priority, then in step S53 all pumps are selected regardless of their running hours. In the example of FIG. 4B all five vacuum pumps 19 are selected for determining the maximum/minimum of the target function in order to optimize the energy consumption of the five vacuum pumps. Thus, all five vacuum pumps are operated as operating vacuum pumps 24 in order to deliver the operation target with minimized energy consumption.

In between for a more balanced priority of increase of maintenance intervals and a reduction of energy consumption, dependent on the priority in step S52 more than those pumps required in order to provide the operation target are selected from the available pumps. In the example of FIG. 4B three of the five vacuum pumps 17 are selected and considered in the target function in order to optimize the target parameter of energy consumption. In this example the two remaining vacuum pumps 3 and 5 may have high running hours. In order to avoid maintenance and increase maintenance intervals, these two vacuum pumps 3, 5 are speared out and only the three vacuum pumps 2, 1, 4 are operated as operating vacuum pumps 22. Therein, the number of selected vacuum pumps is in dependence on the given priority. Thus, with shifting priority from reduction of maintenance requirements as of example 15 in FIG. 4B towards the priority on reduction of energy consumption as of example 19 numerous steps are available corresponding to an increased number of vacuum pumps considered in the target function in order to determine the optimized operation parameters to achieve an optimization of the target parameter. The vacuum pumps system can be operated in an optimal state.

Figure 5:
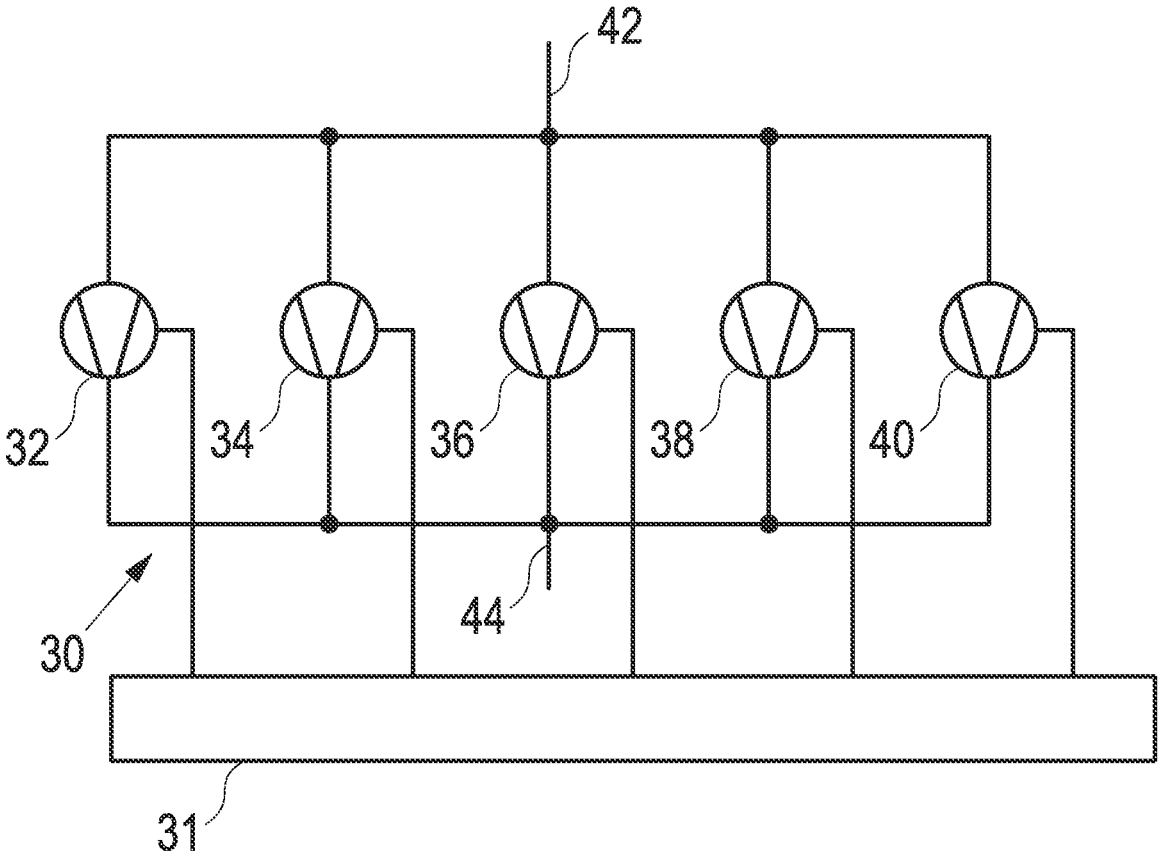

Referring to FIG. 5 showing an example for a pump system 30 having five pumps 32, 34, 36, 38 and 40 arranged in parallel and connected with a common inlet 42 and preferably connected with a common outlet 44 in order to provide a sufficient flow to the pressurized system connected to the pump system 30 to perform a certain task. Therein, the pumps 32, 34, 36, 38 and 40 are each either a compressor or a vacuum pump. Further, each of the pumps 32, 34, 36, 38 and 40 are built as a VSD or a FS. Therein, all pumps 32, 34, 36, 38 and 40 are connected to a common control 31, wherein the control 31 is configured to perform the above mentioned method of operation.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A method for operating a vacuum pump system comprising a plurality of pumps, the method comprising steps of:

obtaining a target parameter to be optimized for the vacuum pump system as a whole;

obtaining an operation target, wherein the operation target is provided by the plurality of pumps operating together with each pump in the plurality of pumps providing a respective operation parameter that contributes to the operation target and wherein the operation target is a flow level or pressure level required to be provided by the vacuum pump system when the vacuum pump system is operating;

performing a first run of adjusting the operation parameters of the plurality of pumps to move the target parameter toward an optimum value for the target parameter while requiring that the operation target is met, wherein during the first run a fixed speed pump of the plurality of pumps is considered as a variable speed pump;

determining that the first run of adjusting the operation parameters resulted in the fixed speed pump being assigned a speed that is greater than zero and less than a full speed of the fixed speed pump, and in response, performing a second run of adjusting the operation parameters of the plurality of pumps to move the target parameter toward the optimum value for the target parameter while requiring that the operation target is met so that the speed of the fixed speed pump is either zero or the full speed to provide adjusted operation parameters for the plurality of pumps, wherein a step size associated with adjusting the operation parameter of the fixed speed pump is larger for the second run than for the first run; and controlling the plurality of pumps to operate with the adjusted operation parameters.

2. The method according to claim 1, characterized in that the operation target is within margin-offsets.

3. The method according to claim 1, characterized in that the target parameter is one or more of energy consumption, water consumption, oil consumption and maintenance reduction of the pump system.

4. The method according to claim 1, wherein the operation parameter of each pump in the plurality of pumps is a ratio, x, of a flow provided by the pump over a maximum flow provided by the pump and the target parameter is the energy consumption, f(x), of the pump system defined as $$f(x) = \sum_{i=1}^{n} g_i(x_i * Q_{imax}) + \sum_{j=1}^{m} x_j * \text{Power}_j,$$

with n being a number of variable speed pumps in the plurality of pumps and m being a number of fixed speed pumps in the plurality of pumps, $g_i$ being a relationship between operation parameter $x_i$ for a variable speed pump i and energy consumption of variable pump i and $\text{Power}_j$ being the energy consumption of a fixed speed pump j operating at the respective full speed of fixed speed pump j.

5. The method according to claim 1, wherein the step size for the first run is below 0.2.

6. The method according to claim 1, characterized in that the step size for the second run is above 0.5.

7. A pump system comprising the plurality of pumps of claim 1 and a controller connected to each pump of the plurality of pumps in order to control operation of each of the pumps of the plurality of pumps, wherein the controller is configured to perform the method according to claim 1.

8. The method according to claim 1 wherein the first run of adjusting the operation parameters results in changed operation parameters and wherein the second run of adjusting the operation parameters starts with the changed operation parameters.

* * * * *